US010066637B2

(12) United States Patent
Nakano et al.

(10) Patent No.: US 10,066,637 B2
(45) Date of Patent: Sep. 4, 2018

(54) IMPELLER FOR CENTRIFUGAL FAN AND CENTRIFUGAL FAN

(71) Applicant: MINEBEA CO., LTD., Kitasaku-gun, Nagano (JP)

(72) Inventors: Tomoaki Nakano, Fukuroi (JP); Yasuhiro Kurosawa, Saku (JP)

(73) Assignee: Minebea Co., Ltd., Nagano (JP)

( * ) Notice: Subject to any disclaimer, the term of this patent is extended or adjusted under 35 U.S.C. 154(b) by 838 days.

(21) Appl. No.: 14/036,033

(22) Filed: Sep. 25, 2013

(65) Prior Publication Data

US 2014/0119922 A1 May 1, 2014

(30) Foreign Application Priority Data

Oct. 29, 2012 (JP) ..... 2012-237925

(51) Int. Cl.
*F01D 5/22* (2006.01)
*F04D 29/28* (2006.01)
*F04D 29/30* (2006.01)

(52) U.S. Cl.
CPC ..... *F04D 29/282* (2013.01); *F04D 29/30* (2013.01)

(58) Field of Classification Search
CPC ..... F04D 29/282; F04D 17/16; F04D 29/26; F04D 29/28; F04D 29/281
See application file for complete search history.

(56) References Cited

U.S. PATENT DOCUMENTS 6,494,676 B2 * 12/2002 Yokoyama ..... F04D 29/30 415/208.3
6,537,030 B1 * 3/2003 Garrison ..... F04D 29/282 416/185
8,562,297 B2 * 10/2013 Yen ..... F04D 29/282 416/186 R
2007/0110572 A1 5/2007 Lan et al.
2013/0108461 A1 * 5/2013 Yoshida ..... F04D 29/329 416/241 R

FOREIGN PATENT DOCUMENTS

| | | | |
|---|---|---|---|
| JP | 07-004389 | A | 1/1995 |
| JP | 2001-012389 | A | 1/2001 |
| JP | 2007032348 | A | 2/2007 |
| JP | 2010185409 | A | 8/2010 |
| JP | 3165611 | U | 1/2011 |
| JP | 2012-047162 | A | 3/2012 |
| WO | 2009143920 | A1 | 12/2009 |

OTHER PUBLICATIONS

Ko, JP2007032348, specification English machine translation.*
Office Action dated May 10, 2016 in corresponding Japanese Patent Application No. 2012-237925.

* cited by examiner

*Primary Examiner* — Igor Kershteyn
*Assistant Examiner* — Jason Fountain
(74) *Attorney, Agent, or Firm* — Carrier Blackman & Associates, P.C.; Joseph P. Carrier; Jeffrey T. Gedeon

(57) ABSTRACT

An impeller for a centrifugal fan includes a main plate having a disc shape, a plurality of blades arranged along a circumferential direction about a center part of the main plate, and an outer ring having a ring shape connecting the respective blades. The outer ring is connected to tip end portions of the respective blades at a side of a fluid discharge opening, and each of the blades has a shape which is bent in a rotating direction of the impeller in a vicinity of the tip end portion.

13 Claims, 20 Drawing Sheets

IMPELLER FOR CENTRIFUGAL FAN AND CENTRIFUGAL FAN

BACKGROUND OF THE INVENTION

1. Field of the Invention

The present invention relates to an impeller for a centrifugal fan and a centrifugal fan, and more particularly, to an impeller having blades connected by an outer diameter ring and a centrifugal fan including the impeller.

2. Description of the Related Art

A centrifugal fan is widely used for cooling, ventilation and air conditioning of an electrical household appliance, an OA device and an industrial device, for a vehicular blower and the like. There has been known a centrifugal fan including an impeller having a plurality of blades, and an outer diameter ring connected to tip end portions of the plurality of blades at a side of a discharge opening so as to support the blades.

JP-A-2012-47162 discloses a structure of a centrifugal fan including an impeller of an open impeller type in which a ring member is connected to tip end portions of blades. The centrifugal fan uses a bell mouth, and the blade is formed with a protrusion part entering an inner side of an air suction opening so as to suppress deterioration of noise performance.

JP-A-2001-12389 and JP-A-H7-4389 disclose a structure of an impeller having no outer diameter ring.

Specifically, JP-A-2001-12389 discloses an impeller of a multi-blade fan in which a discharge tip end portion of each blade is bent in a rotating direction so as to improve a P-Q characteristics. The impeller is not an open impeller type and has a structure where the blades are sandwiched between upper and lower plates.

JP-A-H7-4389 discloses a structure of a turbo fan in which a part of a blade close to an outer periphery of an impeller in a section of a plane perpendicular to a rotary shaft of the impeller is bent to be perpendicular to an outer periphery edge of the impeller. JP-A-H7-4389 adopts this structure so as to reduce a blowing noise.

FIG. 19 is a plan view showing a related-art impeller for centrifugal fan having an outer diameter ring. FIG. 20 is a side sectional view of the related-art impeller.

A related-art impeller 810 for a centrifugal fan is described with reference to FIGS. 19 and 20. The impeller 810 has a disc-shaped main plate 831, a plurality of blades 851 and a ring-shaped outer diameter ring 861. The main plate 831 is formed with a rotor holder 833 at a center thereof. At a state where a rotor of a motor is arranged at an inner side of the rotor holder 833, the impeller 810 rotates about a shaft 871, which is provided at a center of the rotor holder 833, by a driving force of the motor. The impeller 810 rotates in a direction shown with an arrow R in FIG. 19. Thereby, the impeller 810 discharges a fluid, which is suctioned from the upper, to a side of the impeller 810.

The plurality of blades 851 are arranged along a circumferential direction about the center part of the main plate 831. Each of the blades is a backward inclined blade and is formed such that the blade forms a gentle spiral shape from a center part of the impeller 810, when seen from a plan view.

Each blade 851 is connected to an inner side of the outer ring 861 at its trailing edge portion 851*b*. The outer ring 861 is connected to upper portions of the trailing edge portions 851*b* of the respective blades 851, which are spaced upwards from the main plate 831.

An inner diameter of the outer ring 861, an outer diameter of the main plate 831, a height of the blade 851 and a height of the outer ring 861 are set to be about 113 mm, 111 mm, 20 mm and 1 mm, respectively.

In the above impeller 810, since the blades 851 form the spiral shape, the trailing edge portion 851*b* of the blade 851 and an inner periphery of the outer ring 861 are connected at an acute angle (that is, a small and sharp angle). Specifically, an angle (a connection angle), which is formed between a pressure surface of the blade 851 and an inner surface of the outer ring 861 at the connection part of the blade 851 and the outer ring 861, is an acute angle. Therefore, a following problem would be caused.

That is, in a mold for molding the impeller 810, the connection part of the impeller 810 and the outer ring 861 has a sharp shape of an acute angle. However, the mold having the shape is apt to be fractured and a trouble may be thus caused when mass-producing the impeller 810.

SUMMARY OF THE INVENTION

The present invention has been made in view of the above circumstances, and an object of the present invention is to provide an impeller for a centrifugal fan having a high performance and capable of being easily mass-produced and a centrifugal fan having the impeller.

According to an illustrative embodiment of the present invention, there is provided an impeller for a centrifugal fan, including: a main plate having a disc shape; a plurality of blades arranged along a circumferential direction about a center part of the main plate; and an outer ring having a ring shape connecting the respective blades. The outer ring is connected to tip end portions of the respective blades at a side of a fluid discharge opening, and each of the blades has a shape which is bent in a rotating direction of the impeller in a vicinity of the tip end portion.

In the above impeller, each blade may be a backward inclined blade and has a blade thickness which is substantially uniform from a side of a fluid suction opening to the side of the fluid discharge opening.

In the above impeller, a size of the outer ring in an upper-lower direction my range from one to three times of a thickness of each blade.

In the above impeller, a connection angle, which is formed between a pressure surface of each blade and a surface of the outer ring at a connection part of the tip end portion of the blade and the outer ring, may range from 30° to 90°.

In the above impeller, the outer ring may be formed with a plurality of thickness-reduced relief parts which are arranged along the circumferential direction about the center part of the main plate.

In the above impeller, an outer diameter size of the main plate may be smaller than an inner diameter size of the outer ring.

In the above impeller, a size from an upper end of the tip end portion of each blade to a lower end of the outer ring in an upper-lower direction may range 50% or smaller of a size from the upper end of the tip end portion of the blade to an upper surface of the main plate in the upper-lower direction.

In the above impeller, the main plate, the blades and the outer ring may be integrally molded.

In the above impeller, each blade may have a shape configured by connecting a plurality of circular arcs.

According to another illustrative embodiment of the present invention, there is provided a centrifugal fan including:

the above impeller; and a motor configured to rotate a rotary shaft which is attached to the main plate of the impeller.

In the above centrifugal fan, the main plate includes: a rotor holder which is integrally molded at a center of the main plate; an inclined part arranged at an outer side of the rotor holder, wherein a recess part is defined by a bottom surface of the inclined part; and a rib formed in the recess part and connecting the rotor holder and the inclined part, wherein the rib is formed with a cylinder part.

According to the above configuration, the outer ring is connected to the tip end portions of the respective blades at the side of the fluid discharge opening, and each blade has a shape which is bent in the rotating direction of the impeller in the vicinity of the tip end portion. Therefore, there can be provided an impeller for a centrifugal fan having a high performance and capable of being easily-mass produced and a centrifugal fan having the same.

DETAILED DESCRIPTION

Hereinafter, a centrifugal fan according to an illustrative embodiment of the present invention will be described.

A centrifugal fan includes an impeller, a motor which rotates the impeller, and a casing. The centrifugal fan may be used as a circulating fan which is installed to a refrigerator housing so as to circulate air in the refrigerator, for example.

In this illustrative embodiment, an impeller is an open impeller type in which a plurality of blades is arranged on a main plate and an outer ring is connected to outer peripheries of the blades. As described below, the impeller is integrally molded using a resin by a mold of a two-divided structure. In the meantime, the present invention is not limited to the configuration where the impeller is integrally molded as a whole. The impeller may be partially molded and then assembled.

[Structure of Impeller]

Figure 1:
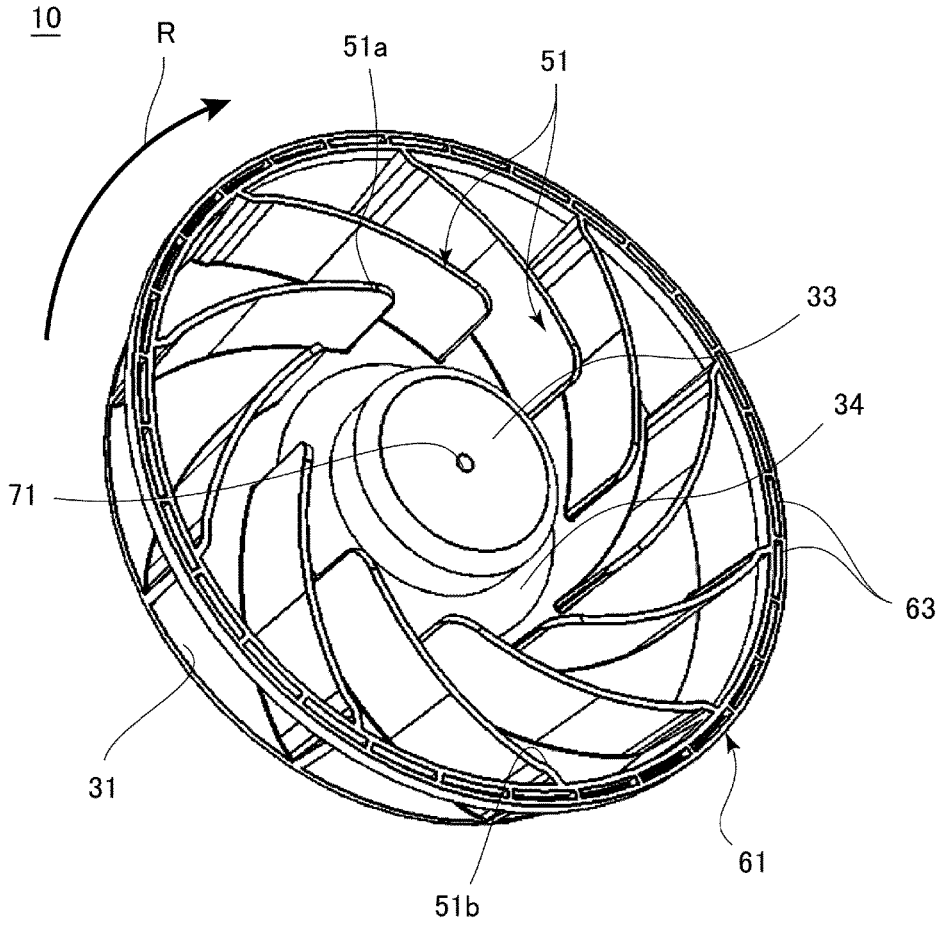
FIG. 1 is a perspective view of an impeller for a centrifugal fan according to an illustrative embodiment, which is seen from an upper side.
Figure 2:
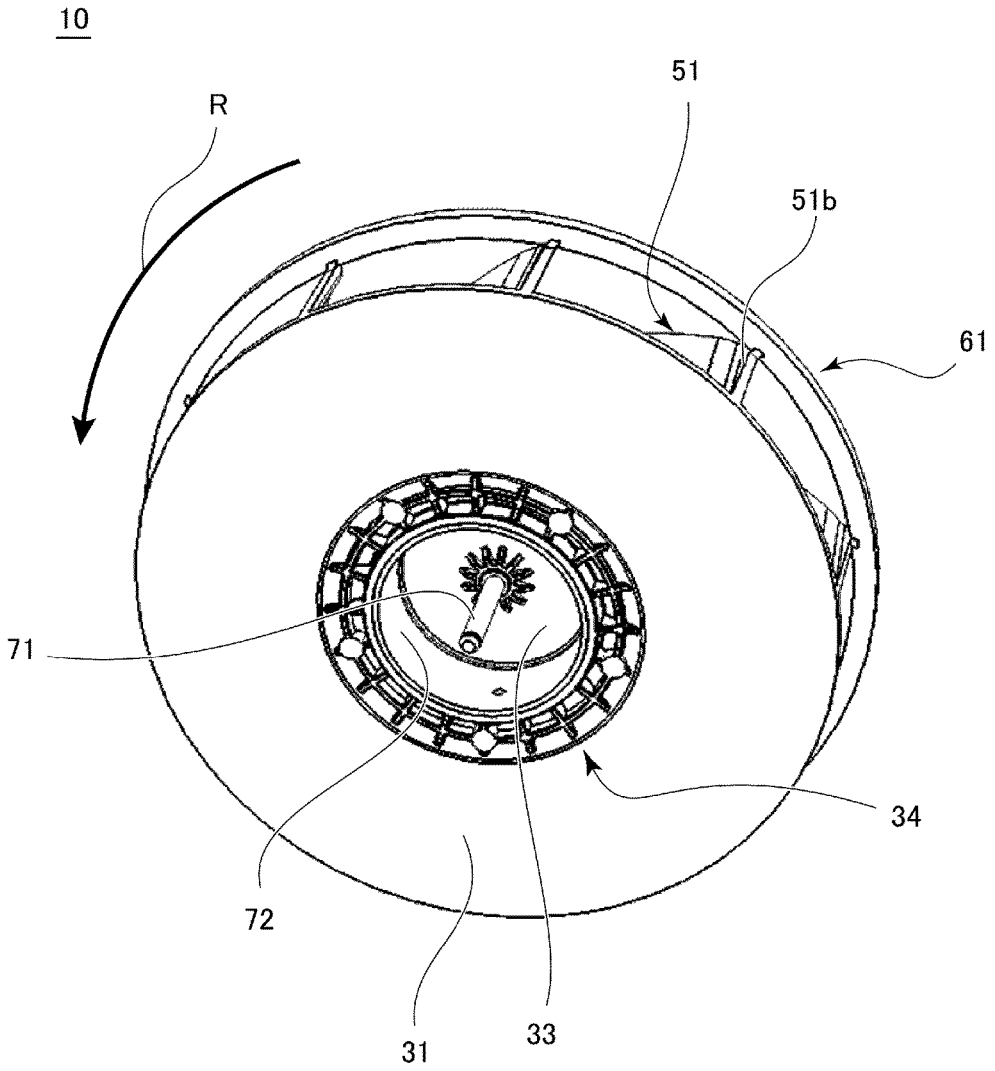
FIG. 2 is a perspective view of the impeller seen from a lower side.
Figure 3:
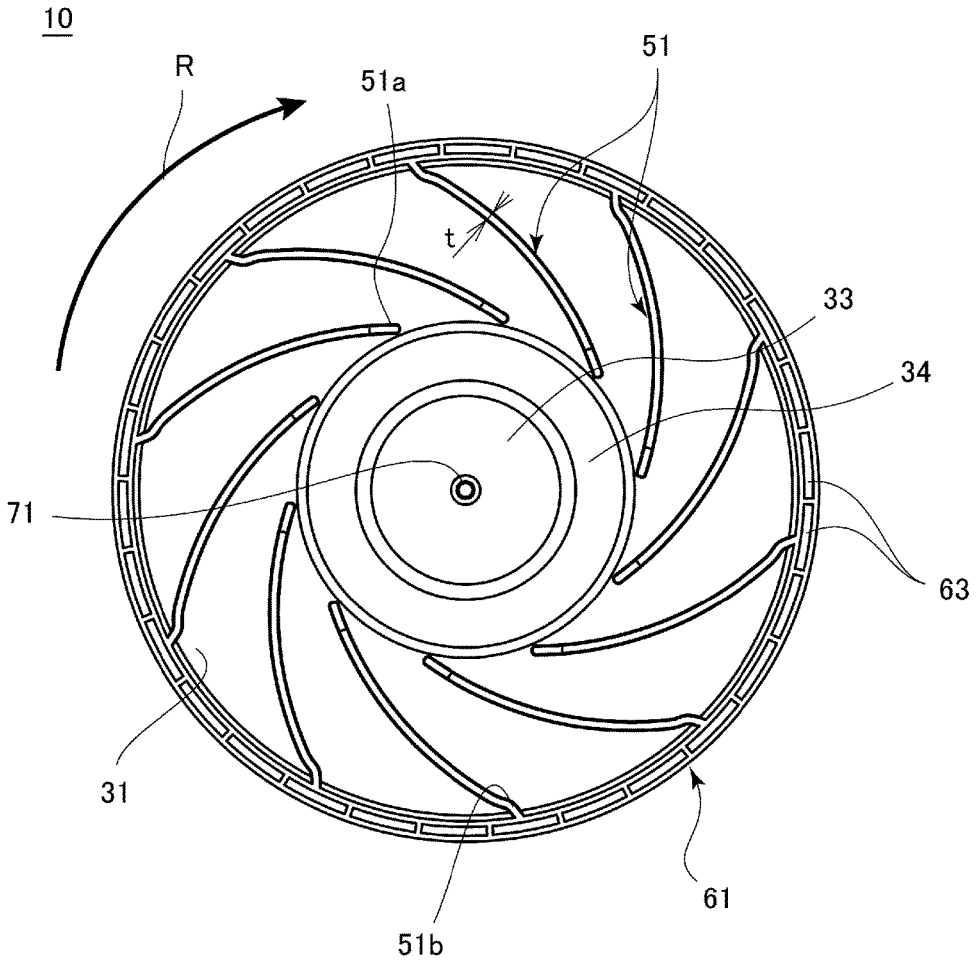
FIG. 3 is a plan view of the impeller.
Figure 4:
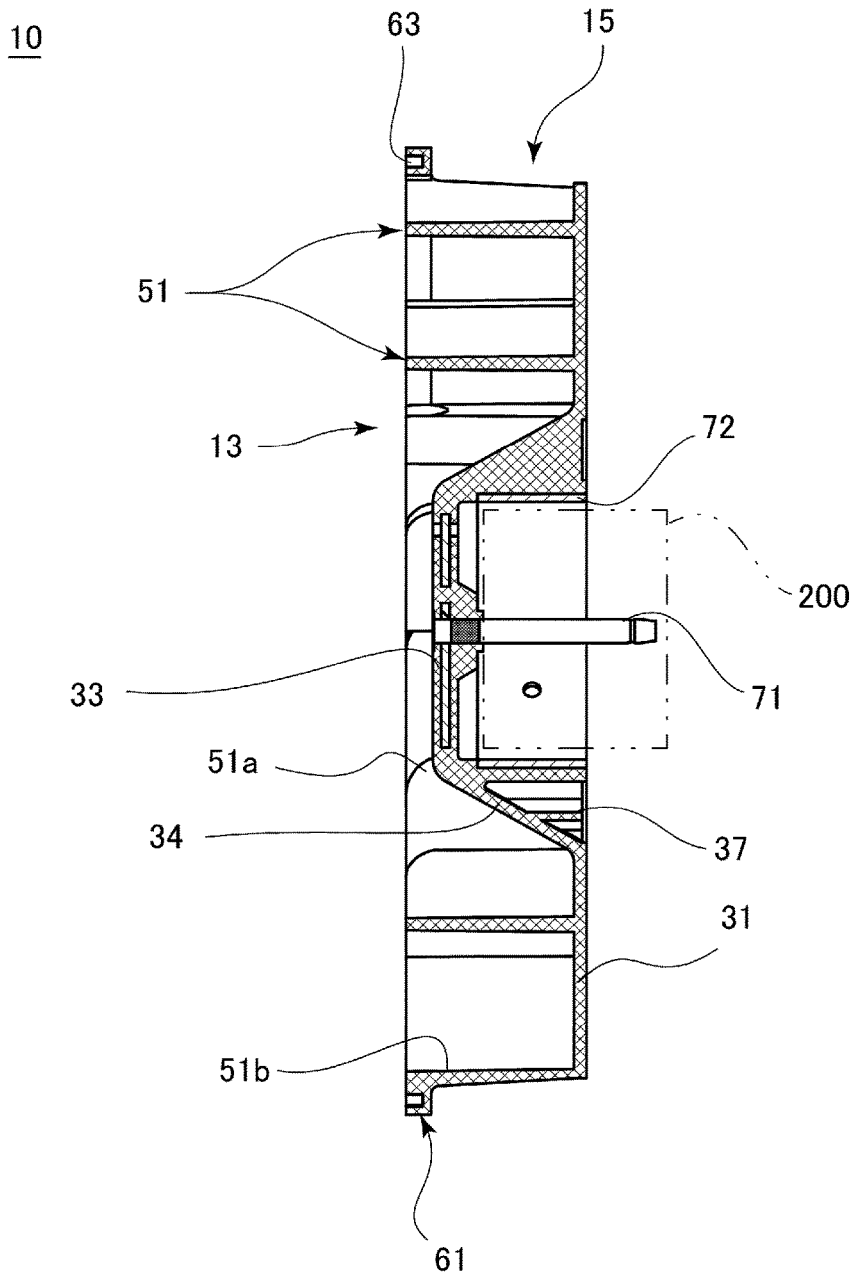
FIG. 4 is a side sectional view of the impeller.

FIG. 1 is a perspective view of an impeller for a centrifugal fan according to this illustrative embodiment, which is seen from an upper side. FIG. 2 is a perspective view of the impeller seen from a lower side. FIG. 3 is a plan view of the impeller. FIG. 4 is a side sectional view of the impeller.

A structure of an impeller is described with reference to FIGS. 1 to 4. An impeller 10 has a main plate 31, a plurality of blades 51 arranged on the main plate (a left direction of FIG. 4), and an outer ring 61 arranged at outer peripheries of the blades 51. The main plate 31, the blades 51 and the outer ring 61 are integrally molded using a resin, so that the impeller 10 is configured.

As shown in FIG. 4, in the impeller 10, an upper surface is a fluid suction opening 13, and a side peripheral surface is fluid discharge openings 15. In FIGS. 1 to 3, an arrow R indicates a rotating direction of the impeller 10. When the impeller 10 is rotated in the rotating direction R, the impeller suctions air (fluid) through the fluid suction opening 13 and discharges the air through the fluid discharge openings 15. The air is discharged in a direction getting away from a shaft 71, which is a rotary shaft of the impeller 10 and is arranged at a center part of the impeller 10.

As shown in FIG. 4, the impeller 10 is mounted to a motor 200 (which is shown with a dashed-two dashed line in FIG. 4) and is used in a centrifugal fan. The motor 200 rotates the impeller 10 in the rotating direction R.

As shown in FIG. 3, the main plate 31 has a disc shape. The main plate 31 is substantially horizontally arranged (arranged in parallel with the sheet in FIG. 3). The main plate 31 is formed with a rotor holder 33 at its center part. The rotor holder 33 protrudes upwards from another part of the main plate 31. The rotor holder 33 is connected to another part of the main plate 31 via an inclined part 34.

In this illustrative embodiment, the impeller 10 has ten blades 51, for example. All the blades 51 are arranged on an upper surface of the main plate 31 such that the blades 51 protrude upwards from the main plate 31. The blades 51 are arranged at an equal interval along a circumferential direction about the rotor holder 33 at the center part of the main plate 31 (in a circumferential direction about the shaft 71 provided at a center of the rotor holder 33).

As shown in FIG. 3, when seen from a plan view, each blade 51 has a substantially uniform thickness t from a leading edge portion 51*a* (a portion at the fluid suction opening 13-side), which is a portion close to the shaft 71, to a trailing edge portion 51*b* (a portion at the fluid discharge opening 15-side), which is a portion distant from the shaft 71.

Each blade 51 is a backward inclined blade (swept-back blade). As shown in FIG. 3, when seen from a plan view, the blade 51 has a shape which extends from the leading edge portion 51*a* in an opposite direction to the rotating direction R, as it becomes distant from the shaft 71. That is, the leading edge portion 51*a* is positioned at the front of the trailing edge portion 51*b* in the rotating direction R. Each of the blades 51 has a gently curved shape such that the blade 51 forms a gentle spiral shape, when seen from a plan view.

The outer ring 61 has a ring shape. The outer ring 61 is connected to the respective blades 51. In other words, the outer ring 61 is arranged to connect the respective blades 51 each other. The outer ring 61 is connected to the trailing edge portions 51*b* of the respective blades 51, i.e., the tip end portions at a side of the fluid discharge opening 15. The trailing edge portions 51*b* of the respective blades 51 are connected to an inner surface of the outer ring 61 and the outer ring 61 is arranged at a position more distant from the shaft 71 than the trailing edge portions 51*b*.

As shown in FIG. 4, the outer ring 61 is positioned at the upper of the impeller 10. In this illustrative embodiment, an upper surface of the trailing edge portion 51*b* of each blade 51 is positioned at substantially same height as an upper surface of the outer ring 61.

Here, as shown in FIG. 1, the outer ring 61 is formed with a plurality of thickness-reduced relief parts 63. The thickness-reduced relief parts 63 are arranged at an equal interval along the circumferential direction about the center part of the main plate 31, i.e., in the circumferential direction about the shaft 71. Each thickness-reduced relief part 63 is a recess part which is recessed downwards from the upper surface of the outer ring 61.

By forming the thickness-reduced relief parts 63, a weight and inertia moment of the impeller 10 can be reduced. Also, since the thickness-reduced relief parts 63 are provided, moldability of the impeller 10 can be improved and a balance of the impeller 10 can be easily secured. That is, even when a sectional area of the outer ring 61 is increased to secure higher stiffness, the thickness-reduced relief parts 63 are formed, so that shrinkage of a resin upon resin-molding of the impeller 10 can be prevented, thereby preventing deformation. A size and a position of each thickness-reduced relief part 63 can be changed by a mold, to attach weights to the thickness-reduced relief parts 63, and the thickness-reduced relief parts 63 can be used as adjusting holes for balance adjustment of the impeller 10.

As shown in FIG. 2, a bottom surface of the main plate 31 is formed with the rotor holder 33 and is thus recessed upwards. That is, an inner side of the recessed rotor holder 33 has a bottomed cylinder shape. The shaft 71 and a rotor yoke 72 are arranged at the inner side of the rotor holder 33.

The shaft 71 is inserted and fixed to a ceiling surface of the rotor holder 33. The shaft 71 is rotatably held by the motor 200.

As shown in FIG. 4, the rotor yoke 72 has a cylinder shape. The rotor yoke 72 is inserted into the inner side of the rotor holder 33 and is held by the rotor holder 33. Constitutional parts (not shown) of the motor 200 such as a magnet, a stator core and the like are arranged at the inner side of the rotor yoke 72. The motor 200 is a brushless motor in which a magnet is fixed to the rotor yoke 72, for example.

Figure 5:
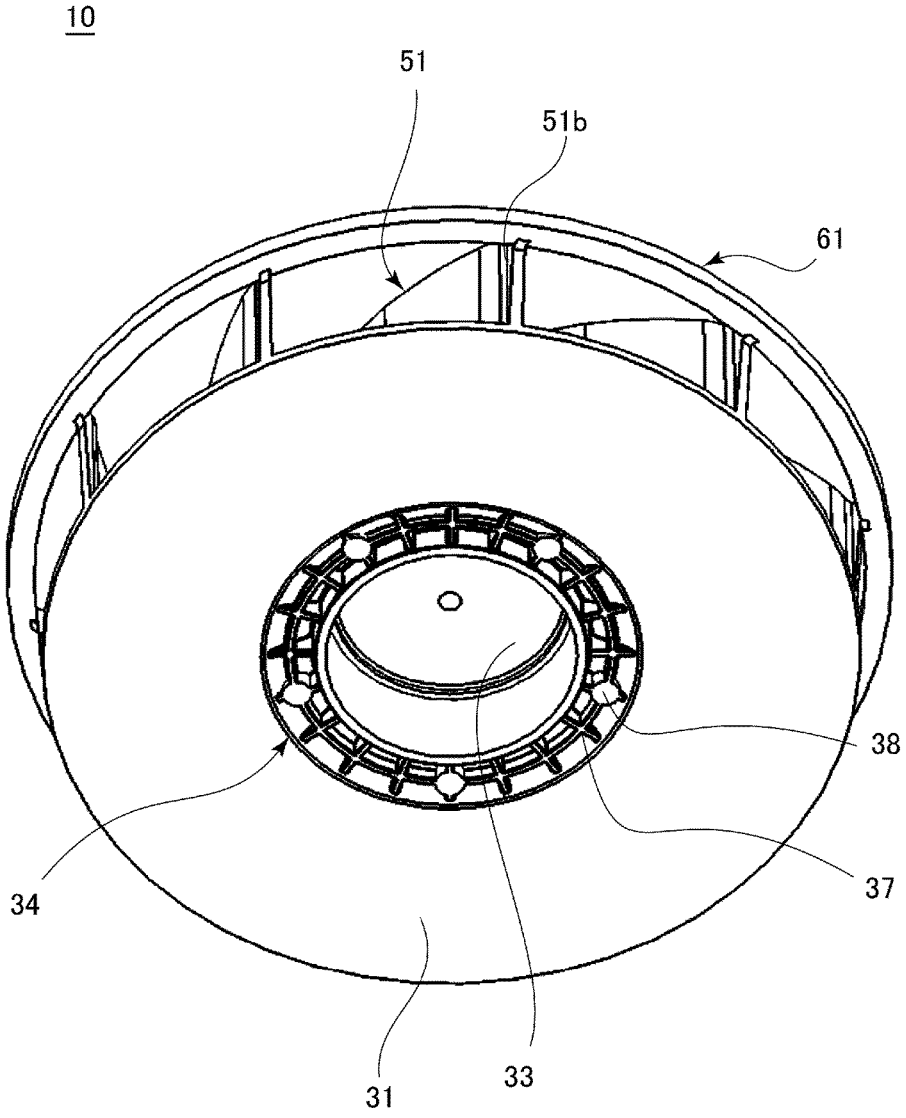
FIG. 5 is a perspective view of the impeller seen from a bottom side.

FIG. 5 is a perspective view of the impeller 10 seen from a bottom side.

In FIG. 5, the shaft 71 and the rotor yoke 72 are not shown. As shown in FIG. 5, the inclined part 34 is arranged in a ring shape around the rotor holder 33. A bottom surface of the inclined part 34 is provided with a rib 37 extending to a height which is substantially at the same height as the bottom surface of the main plate 31. Thereby, the strength can be secured, a thickness of the inclined part 34 can be made substantially the same as a thickness of the main plate 31, and the impeller 10 can be easily molded.

At the inclined part 34, the rib 37 is formed with cylinder parts 38 having a small cylindrical column shape. As shown in FIG. 5, the cylinder parts 38 are disposed at five places at a substantially equal interval around the rotary shaft of the impeller 10. In this illustrative embodiment, the cylinder part 38 is a part with which an ejector pin collides upon mold release, for example. Also, the cylinder part 38 is a part at which a gate is provided upon the molding.

[Sizes of Respective Parts]

Figure 6:
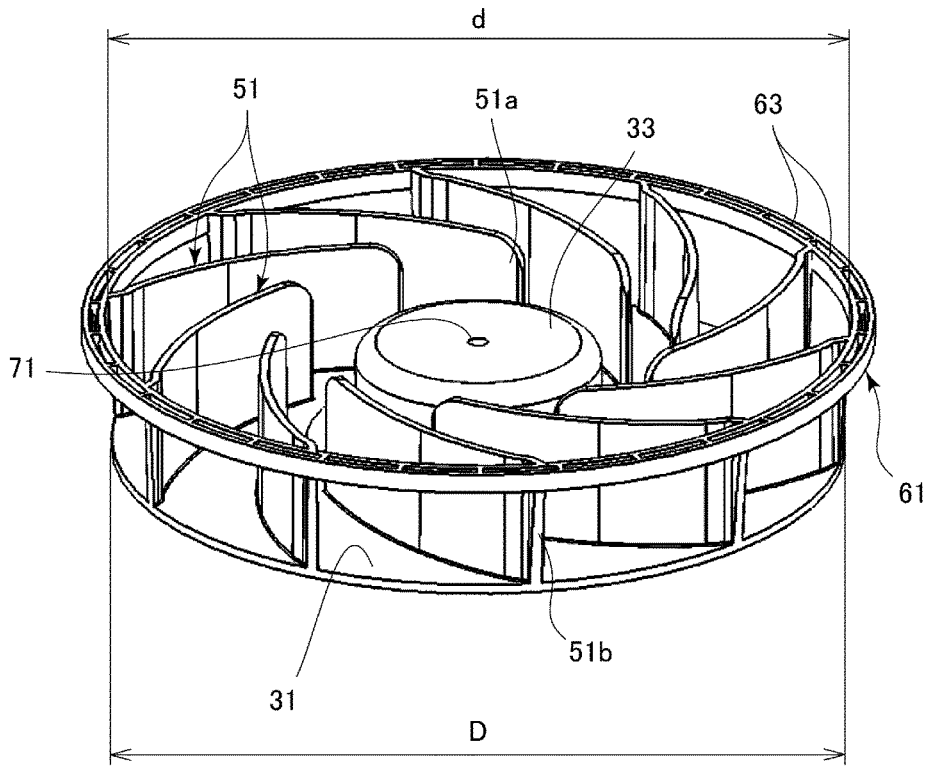
FIG. 6 is a perspective view of the impeller seen from an upper side.
Figure 7:
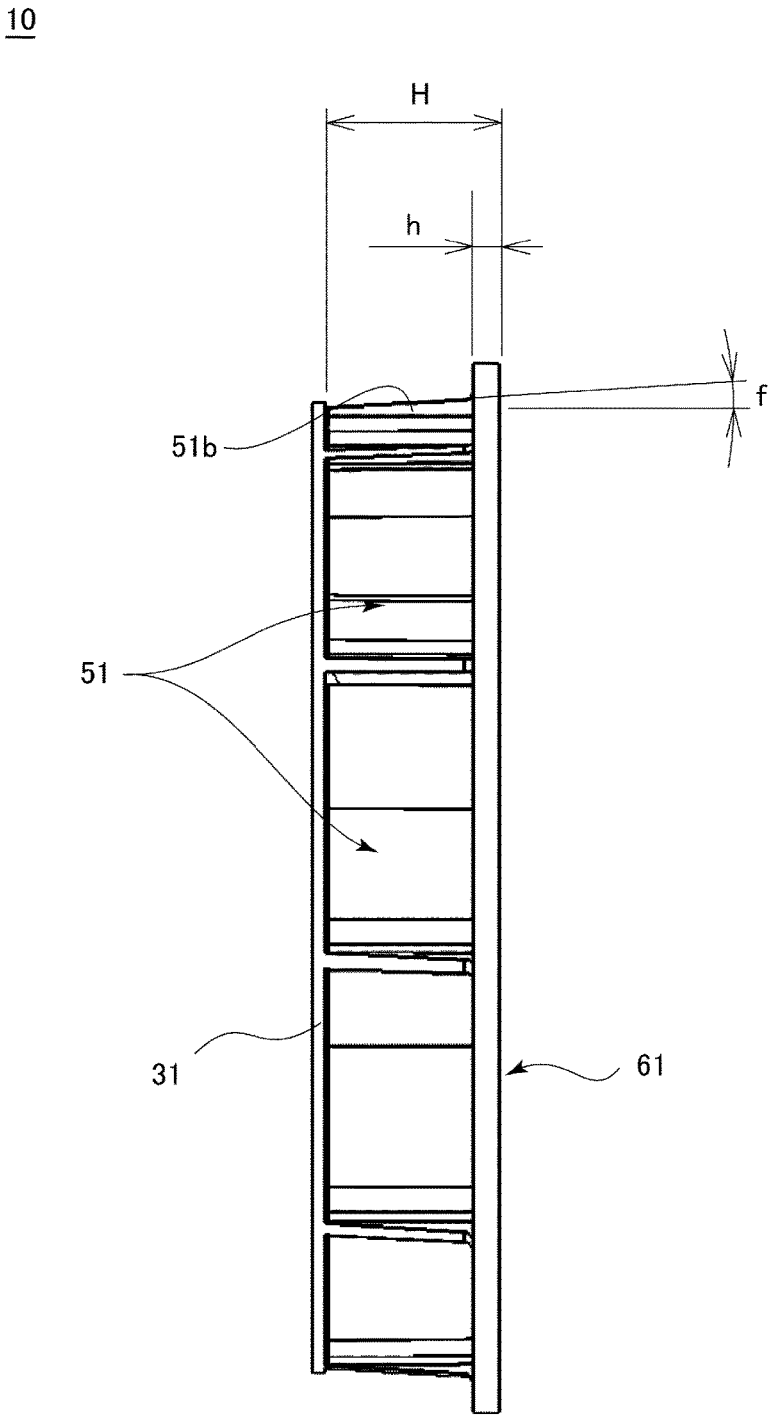
FIG. 7 is a side view of the impeller.

FIG. 6 is a perspective view of the impeller 10 seen from an upper side. FIG. 7 is a side view of the impeller 10.

In FIG. 6, a size D indicates an outer diameter size D of the main plate 31. Also, a size d indicates an inner diameter size d of the outer ring 61. In FIG. 7, a size H indicates a higher H of the blade 51, i.e., a size of the blade in the upper-lower direction. A size h indicates a height h of the outer ring 61, i.e., a size of the outer ring in the upper-lower direction. An angle f indicates an inclined angle of the trailing edge portion 51*b* of the blade 51 relative to the rotary shaft of the impeller 10. In this illustrative embodiment, the above sizes are as follows.

The inner diameter size d of the outer ring 61 is a diameter of 113 mm.

The outer diameter size D of the main plate 31 is a diameter of 111 mm.

The height H of the blade 51 is 20 mm.

The height h of the outer ring 61 is 3 mm.

The inclined angle f of the trailing edge portion 51*b* is 3°.

The height h of the outer ring 61 preferably ranges from one to three times of the thickness t of the blade 51, for example. In this illustrative embodiment, while the thickness t of the blade 51 is about 1.5 mm, the height h of the outer ring 61 is set to be about 3 mm which is two times of the thickness. By setting so, the blade 51 and the outer ring 61 are connected at a state where a sufficient strength is secured. Also, the overall stiffness of the impeller 10 can be improved in good balance.

The outer diameter size D of the main plate 31 is set to be smaller than the inner diameter size d of the outer ring 61. By setting so, the impeller 10 can be molded with a mold having a simple configuration. In this illustrative embodiment, an outer diameter of the main plate 31 is smaller than an inner diameter of the outer ring 61 about by 1 mm in terms of a radius. That is, when seen from a plan view, a gap of minimum 1 mm is secured between an inner periphery of the main plate 31 and an inner periphery of the outer ring 61. Thereby, a mold for molding the impeller 10 can have a two-divided structure of a moveable mold and a fixed mold.

In the meantime, when the outer diameter size D of the main plate 31 is smaller than the inner diameter size d of the outer ring 61, as described above, the trailing edge portion 51*b* of the blade 51 is inclined relative to the rotary shaft of the impeller 10. In this illustrative embodiment, since the height H of the blade 51 is 20 mm, the inclined angle f is set to be 3°.

Here, a size from an upper end of the trailing edge portion 51*b* to a lower end of the outer ring 61 in the upper-lower direction is preferably set to be 50% or smaller of a size from the upper end of the trailing edge portion 51*b* to the upper surface of the main plate 31. In other words, the height h of the outer ring 61 is preferably set to be 50% or smaller of the height H of the blade 51. In this illustrative embodiment, the height h of the outer ring 61 is 3 mm, which is about 15% of the height H.

Figure 8:
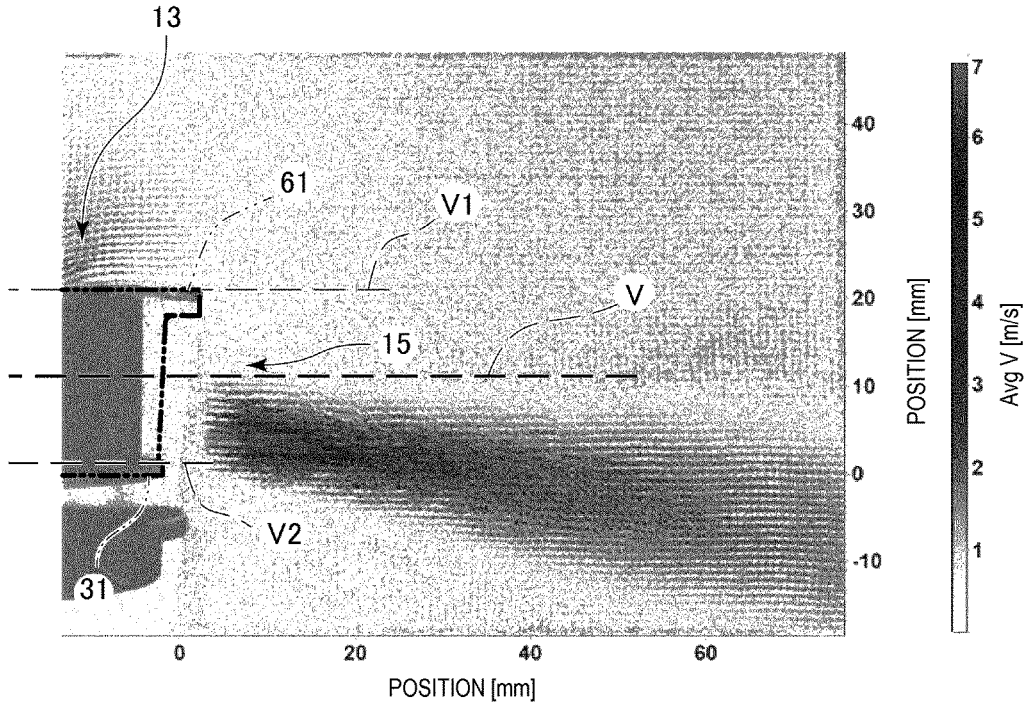
FIG. 8 is a view visualizing a flow velocity of air discharged from a fluid discharge opening.

FIG. 8 is a view visualizing a flow velocity of air discharged from the fluid discharge opening 15.

FIG. 8 shows a simulation result of an impeller which is substantially the same as the impeller 10 of this illustrative embodiment. In FIG. 8, a dashed line V indicates a position which is distant from the upper end of the trailing edge portion 51*b* by a distance of 50% of the height H of the blade 51. A dashed line V1 indicates a position of the upper end of the trailing edge portion 51*b*. A dashed line V2 indicates a position of the upper surface of the main plate 31.

In FIG. 8, a part which is colored with a dark color indicates that a flow velocity of air is high. According to the visualization result shown in FIG. 8, the air which is discharged from a height range (a range below the dashed line V) of about 50% from the main plate 31 occupies most of air which is discharged from the fluid discharge openings 15. An air volume in the height range of about 50% from the main plate 31 occupies 98% or larger of an air volume in an overall range of the fluid discharge openings 15. Therefore, when the height h of the outer ring 61 is set to be 50% or smaller of the height H of the blade 51, i.e., the height of the fluid discharge opening 15, the air discharge would not be interrupted by the outer ring 61.

In the meantime, when the height h of the outer ring 61 is set to be larger, it has an influence on a mass of the impeller 10, the cost of a material to be used, a depth of the thickness-reduced relief part 63 and the like. Therefore, it is not necessary to make the height h large beyond necessity and it is preferable to set an appropriate size, considering the stiffness of the blade 51 and/or the outer ring 61. For example, it is preferable to set the height h to be 15% or smaller of the height H, considering the integral moldability, characteristics, stiffness and the like of the impeller 10.

[Detailed Shape of Blade 51]

Here, the blade 51 has a shape which is bent in the rotating direction R of the impeller 10 at a part adjacent to the tip end portion thereof, i.e., a part adjacent to the trailing edge portion 51*b*.

Figure 9:
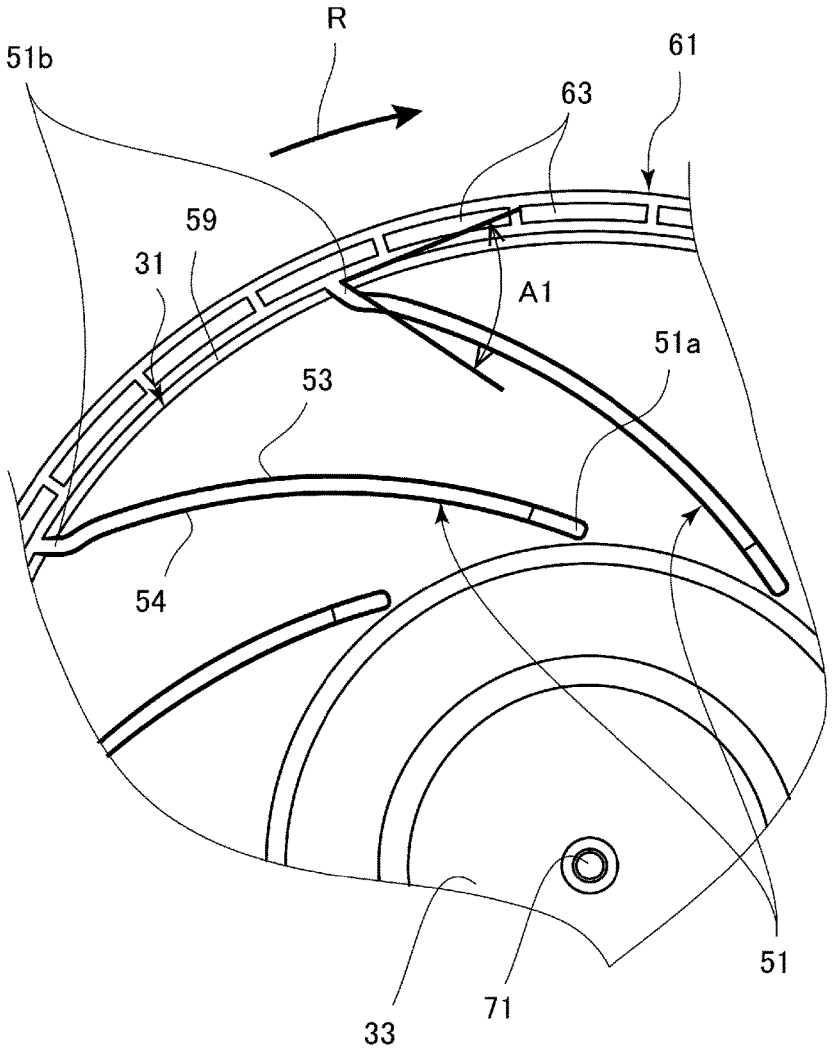
FIG. 9 is an enlarged plan view showing blades.

FIG. 9 is an enlarged plan view showing the blades 51.

As shown in FIG. 9, the blade 51 has a pressure surface 53 and a negative pressure surface 54. The pressure surface 53 faces a front side in the rotating direction R of the impeller 10. The negative pressure surface 54 faces an opposite side to the pressure surface 53.

A specific shape of each blade 51 is as follows, for example. That is, when seeing the pressure surface 53 from a direction along which the rotary shaft of the impeller 10 extends, the blade has a shape configured by connecting a plurality of circular arcs (for example, circular arcs of three types). The circular arcs are connected such that the neighboring circular arcs are tangent to each other. Thereby, the blade 51 has a gentle spiral shape that, as it becomes distant from the shaft 71, the blade is gradually bent towards the adjacent blade 51 provided at the rear in the rotating direction R and is thus difficult to come close to a side circumference of the impeller 10.

However, in this illustrative embodiment, a portion close to the trailing edge portion 51*b* of the blade 51, i.e., a portion close to the outer ring 61 is bent back towards the rotating direction R such that it sharply comes close to the side circumference of the impeller 10, unlike a portion closer to the shaft 71.

A connection angle A1 is defined between the pressure surface 53 of the blade 51 and the inner surface of the outer ring 61 at a connection part between the inner periphery of the outer ring 61 and the trailing edge portion 51*b* of the blade 51 which is bent back towards the rotating direction R. The connection angle A1 preferably ranges from 30° to 90°. In this illustrative embodiment, the connection angle A1 is 59.4°, for example.

Figure 10:
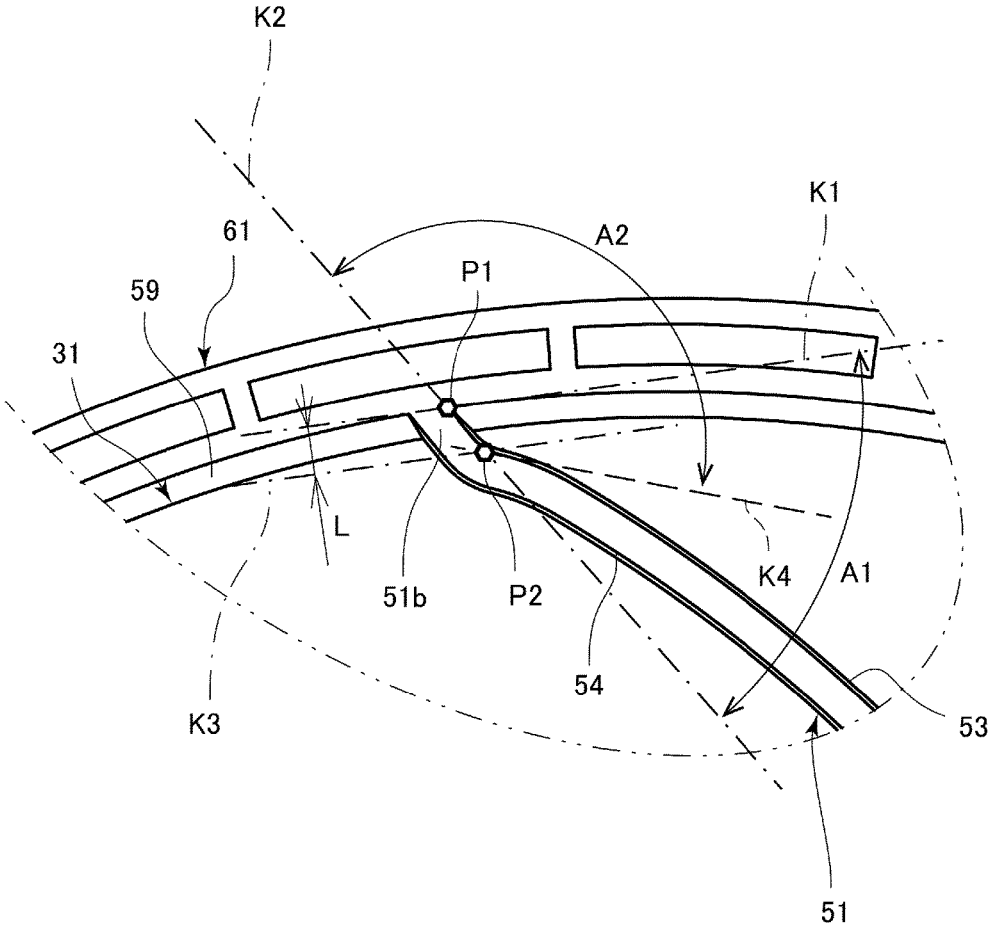
FIG. 10 is a view showing a shape in the vicinity of a trailing edge portion of the blade.

FIG. 10 is a view showing a shape of the portion close to the trailing edge portion 51*b* of the blade 51.

The shape of the part at which the trailing edge portion 51*b* and the outer ring 61 are connected is specifically described with reference to FIG. 10. When seen from a plan view, the shape of the portion close to the trailing edge portion 51*b* is set as follows, for example.

That is, a tangent line K1 of an inner periphery circular arc of the outer ring 61 is first determined at a connection part P1 of the outer ring 61 and the blade 51. Then, the angle A1 (connection angle) of the pressure surface 53 (a line K2) of the blade 51 relative to the tangent line K1 at the connection part P1 is determined. The angle A1 is preferably set within an angle range which will be described later, for example.

Then, a starting point P2 is determined which is distant from the tangent line K1 towards the shaft 71 by a distance L of 1 mm or larger, is on an extension line of the circular arc of the pressure surface 53 of the blade 51 and is an intersecting point with the line K2. The starting point P2 is determined such that an angle A2 between a tangent line K4 at the starting point P2 of the pressure surface 53 and the line K2 is 135° or larger. In this illustrative embodiment, the angle A2 is configured to be about 147.8°, for example.

Then, when seen from a plan view, the line K2 and a line corresponding to the pressure surface 53 are connected with a circular arc or smooth curved line to pass a vicinity of the determined starting point P2. A tip end portion and a portion of the blade, which continue from the starting point P2, are connected with a round shape or smooth curved line. Further, the connection part of the outer ring 61 and the trailing edge portion 51*b* is positioned frontward in the rotating direction R than a line corresponding to the pressure surface 53 at an inner side of the connection part and a line formed by extrapolating the corresponding line towards the outer ring 61.

Here, the connection angle A1 is preferably set to between 30° to 90°, more preferably between 45° to 80°, considering a structure of a mold. In this illustrative embodiment, the connection angle A1 is set to be about 59.4°.

Since the trailing edge portion 51*b* of each blade 51 is bent as described above, the connection angle A1 is increased, compared to a configuration where the trailing edge portion 51*b* is not bent. Since the connection angle A1 is set within the predetermined angle range, a lifespan of a mold for forming the impeller 10 can be extended.

[Molding Method of Impeller 10]

Figure 11:
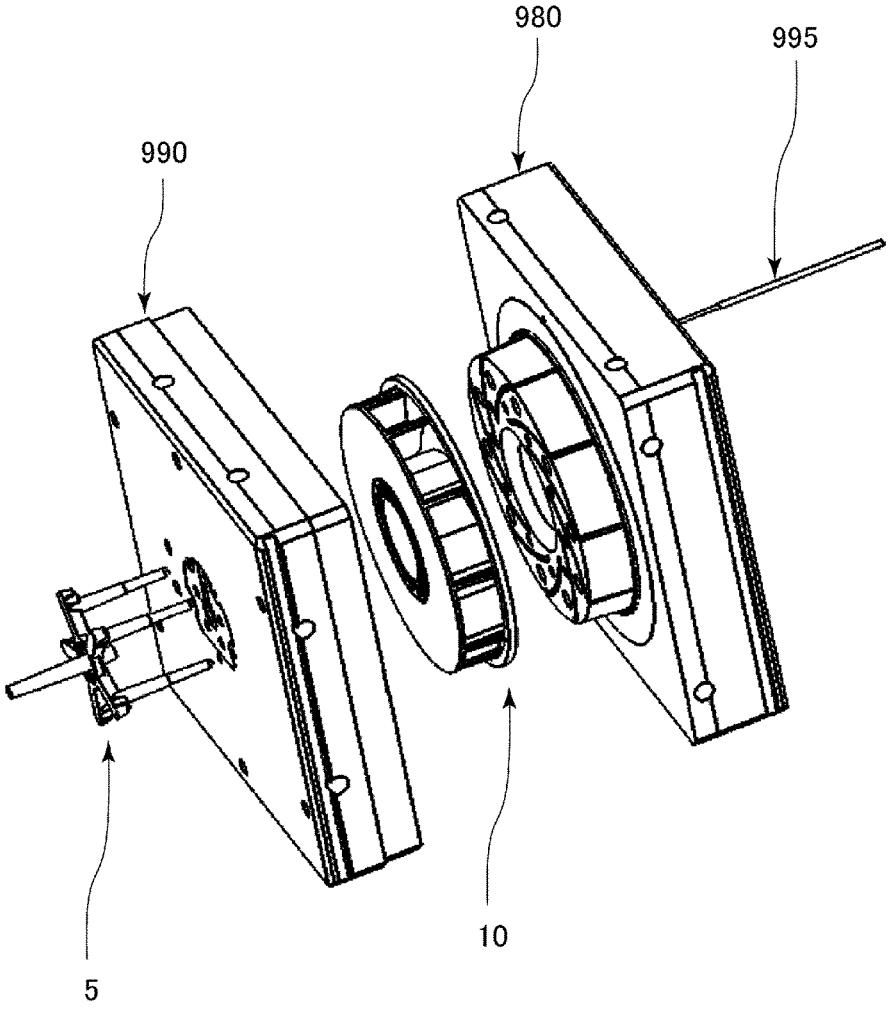
FIG. 11 is a perspective view illustrating a molding method of the impeller.

FIG. 11 is a perspective view illustrating a molding method of the impeller 10.

As shown in FIG. 11, in this illustrative embodiment, the impeller 10 is integrally molded using a synthetic resin by a mold of a two-divided structure. That is, as the mold, a moveable mold 980 and a fixed mold 990 are use.

The fixed mold 990 molds mainly a bottom surface side of the impeller 10. At a bottom surface side (a left side in FIG. 11) of the fixed mold 990, a runner for injecting resin is shown. In this illustrative embodiment, the resin is injected through five gates, for example. However, the number or positions of the gates are not limited thereto. For example, the resin may be injected through ten gates to thus improve a balance of the impeller 10.

Figure 12:
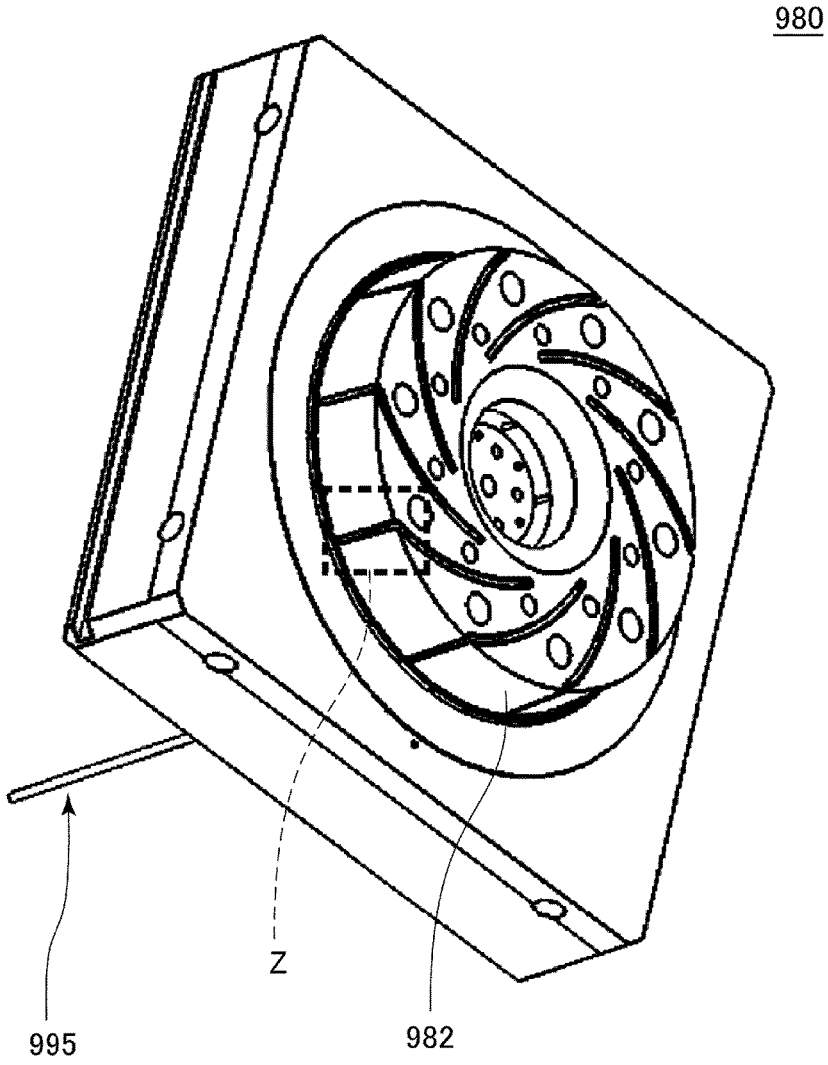
FIG. 12 is a perspective view showing a moveable mold.

FIG. 12 is a perspective view showing the moveable mold 980.

As shown in FIG. 12, the moveable mold 980 molds mainly the upper surface of the impeller 10. That is, the moveable mold 980 molds the thickness-reduced relief parts 63 and the blades 51. The moveable mold 980 has a protrusion part 982 forming a part that becomes a flow path of air. The protrusion part 982 is formed with recesses for forming the blades 51.

Returning to FIG. 11, at an upper surface side (a right side in FIG. 11) of the moveable mold 980, an ejector pin 995 is shown. The ejector pin 995 is inserted from the moveable mold 980 towards the impeller 10 after the molding. Thereby, the impeller 10 is pushed out from the moveable mold 980 and is thus released from the mold.

Figure 13:
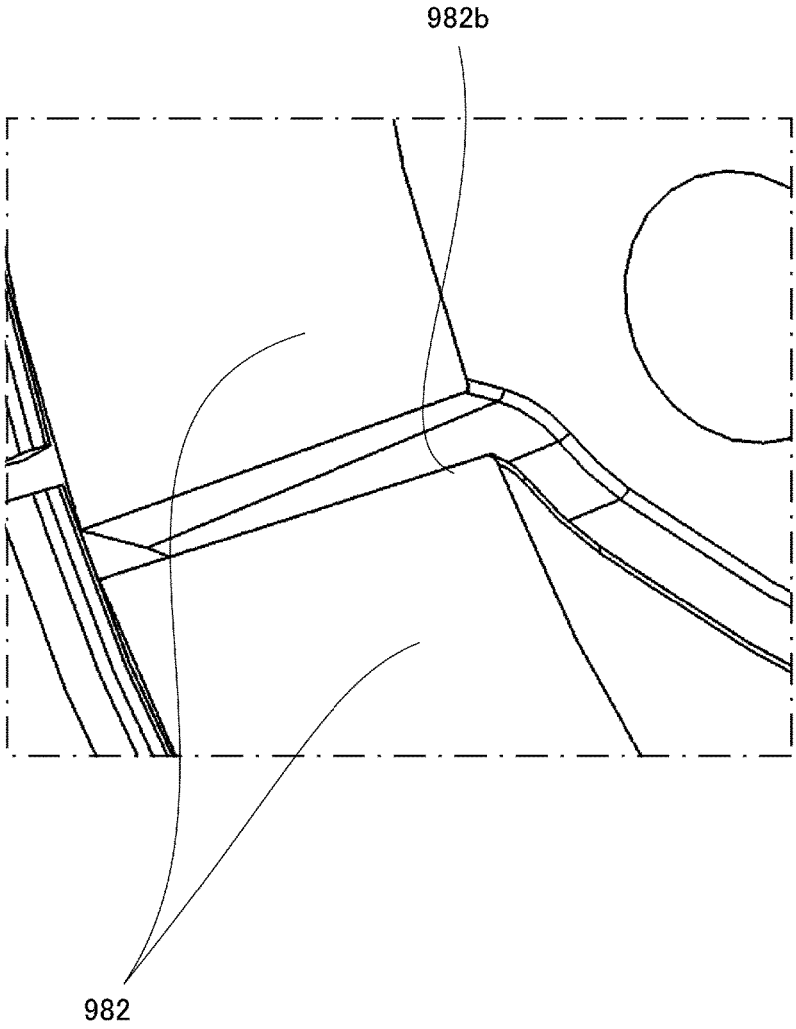
FIG. 13 is an enlarged view showing a range Z of FIG. 12.

FIG. 13 is an enlarged view showing a range Z of FIG. 12.

Here, in this illustrative embodiment, as described above, since the trailing edge portion 51*b* of the blade 51 is bent in the rotating direction R and the connection angle A1 is thus set to be relatively large, an extent of the acute angle is also reduced in a part of the moveable mold 980 molding the corresponding part. That is, as shown in FIG. 13, the part of the pressure surface 53 of the trailing edge portion 51*b* is molded by a tip end portion 982*b* of the protrusion part 982. Here, since the connection angle A1 of the trailing edge portion 51*b* is set to be large, as described above, an angle which is formed by the tip end portion 982*b* is also increased, when seen from a plan view. That is, since the extent of the acute angle of the tip end portion 982*b* is reduced and a thickness of the tip end portion 982*b* is secured, the tip end portion 982*b* is not apt to be fractured. Therefore, a lifespan of the moveable mold 980 can be extended, and the impeller 10 can be easily molded. As a result, the manufacturing cost of the impeller 10 can be reduced.

[Comparison of Characteristics of Centrifugal Fan with Related Art]

In this illustrative embodiment, the blades 51 are connected each other by the outer ring 61 having the larger size in the upper-lower direction, compared to the related art. That is, the outer ring 61 is made to have the different height, so that the impeller 10 has following characteristics, compared to an impeller having a related-art structure.

Here, an outer ring of a related-art impeller, which is described below as a comparison object, has a height of 1 mm. On the other hand, the outer ring 61 of the impeller, which is described as this illustrative embodiment, has a height h of 3 mm. However, the shape of the blade 51 is all the same in this illustrative embodiment and the related art.

Figure 14:
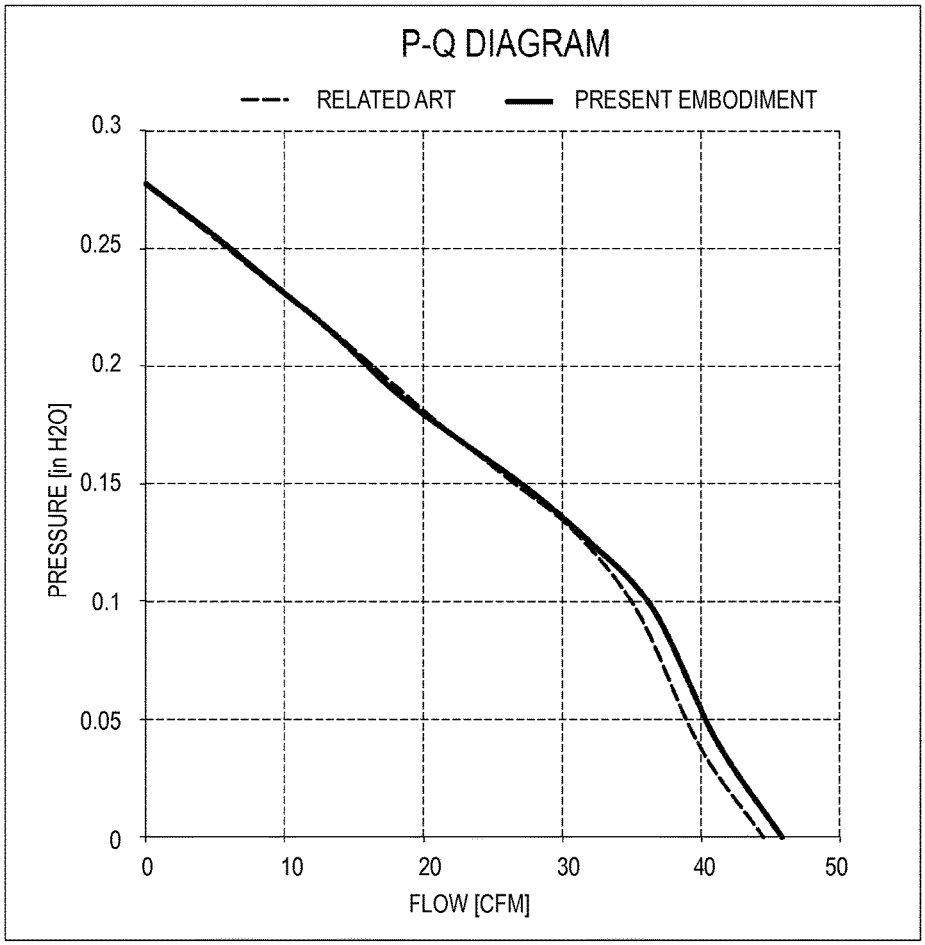
FIG. 14 is a P-Q diagram of a centrifugal fan using the impeller.

FIG. 14 is a P-Q diagram of a centrifugal fan using the impeller 10.

In FIG. 14, a P-Q diagram of a centrifugal fan using the impeller 10 is shown together with the related-art centrifugal fan (which is shown with the dashed line). As can be seen from the graph, the centrifugal fan of this illustrative embodiment has the same characteristics as the related-art centrifugal fan in an intermediate area from a maximum static pressure to a maximum flow rate. However, in a high area in which the flow rate is high, the characteristics are improved, and the maximum flow rate is increased at the same static pressure. That is, it can be said that the centrifugal fan of this illustrative embodiment has an improved efficiency.

Figure 15:
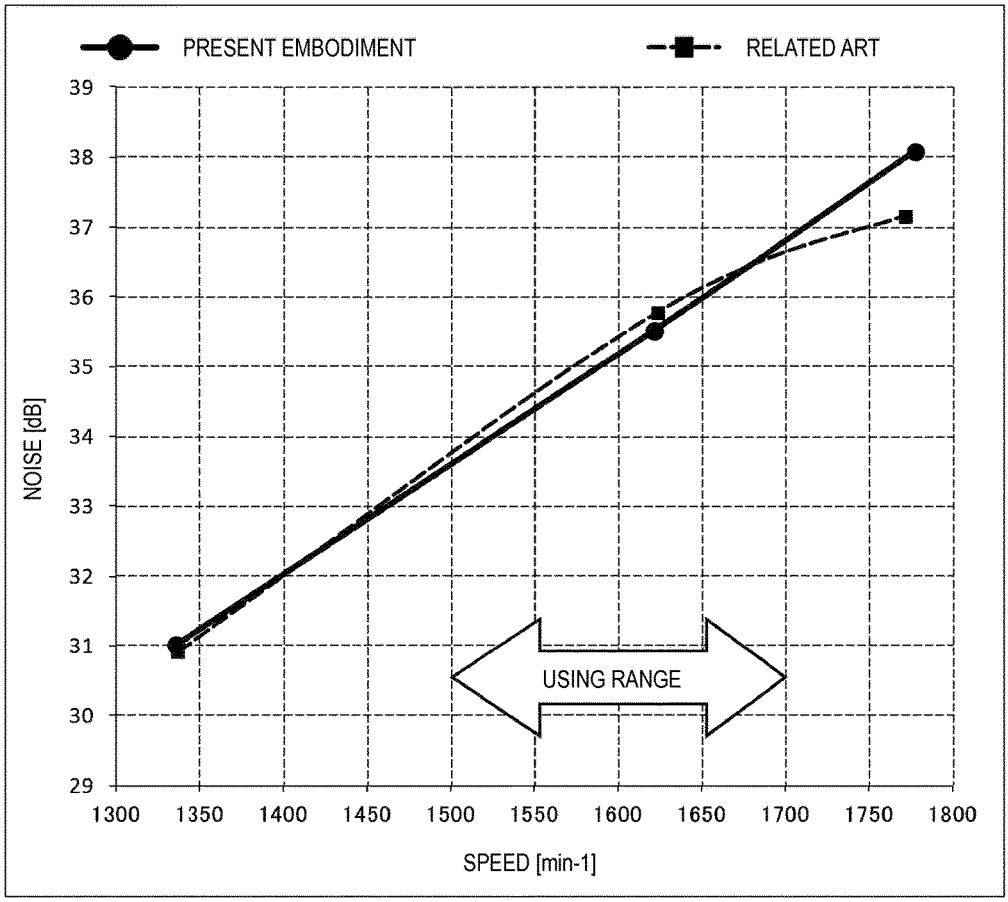
FIG. 15 is a noise characteristics diagram of a centrifugal fan using the impeller.

FIG. 15 is a noise characteristics diagram of a centrifugal fan using the impeller 10.

As shown in FIG. 15, in a range of 1400 revolutions to 1700 revolutions per minute, a noise level is lower in the centrifugal fan of this illustrative embodiment than the related-art centrifugal fan. In the meantime, in an area of 1700 revolutions or more per minute, the noise level is lower in the related-art centrifugal fan than the centrifugal fan of this illustrative embodiment.

Here, a range of the revolutions in which the centrifugal fan of this illustrative embodiment is generally used is 1500 revolutions to revolutions a little under 1700 revolutions per minute. Therefore, it can be said that the centrifugal fan of this illustrative embodiment has the reduced noise level in the range to be typically used.

[Relation of Height of Outer Ring 61 and Characteristics of Centrifugal Fan]

In the configuration where the trailing edge portion 51*b* of the blade 51 is bent as described above, when the height h of the outer ring 61 is 1 mm (1 mm), 2 mm (2 mm) and 3 mm (3 mm), the characteristics of the centrifugal fan are as follows.

Figure 16:
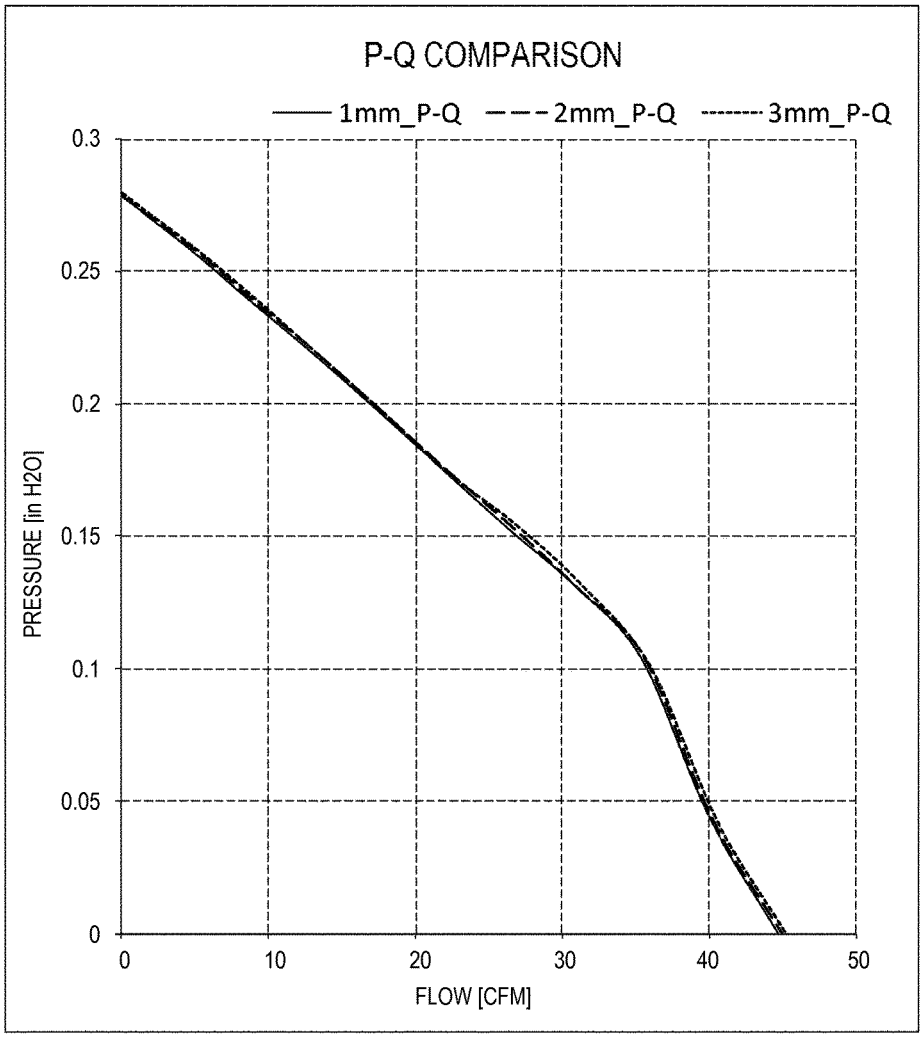
FIG. 16 is a P-Q diagram of a centrifugal fan using the impeller in accordance with heights of an outer ring.

FIG. 16 is a P-Q diagram of a centrifugal fan using the impeller 10 in accordance with heights of the outer ring 61.

As shown in FIG. 16, the properties are little different in the cases of 1 mm, 2 mm, and 3 mm. That is, the height h of the outer ring 61 can be appropriately set within the range of 1 mm to 3 mm without influencing the P-Q characteristics, considering the stiffness of the impeller 10, the amount of resin to be used and a degree of deformation of the blade 61

Figure 17:
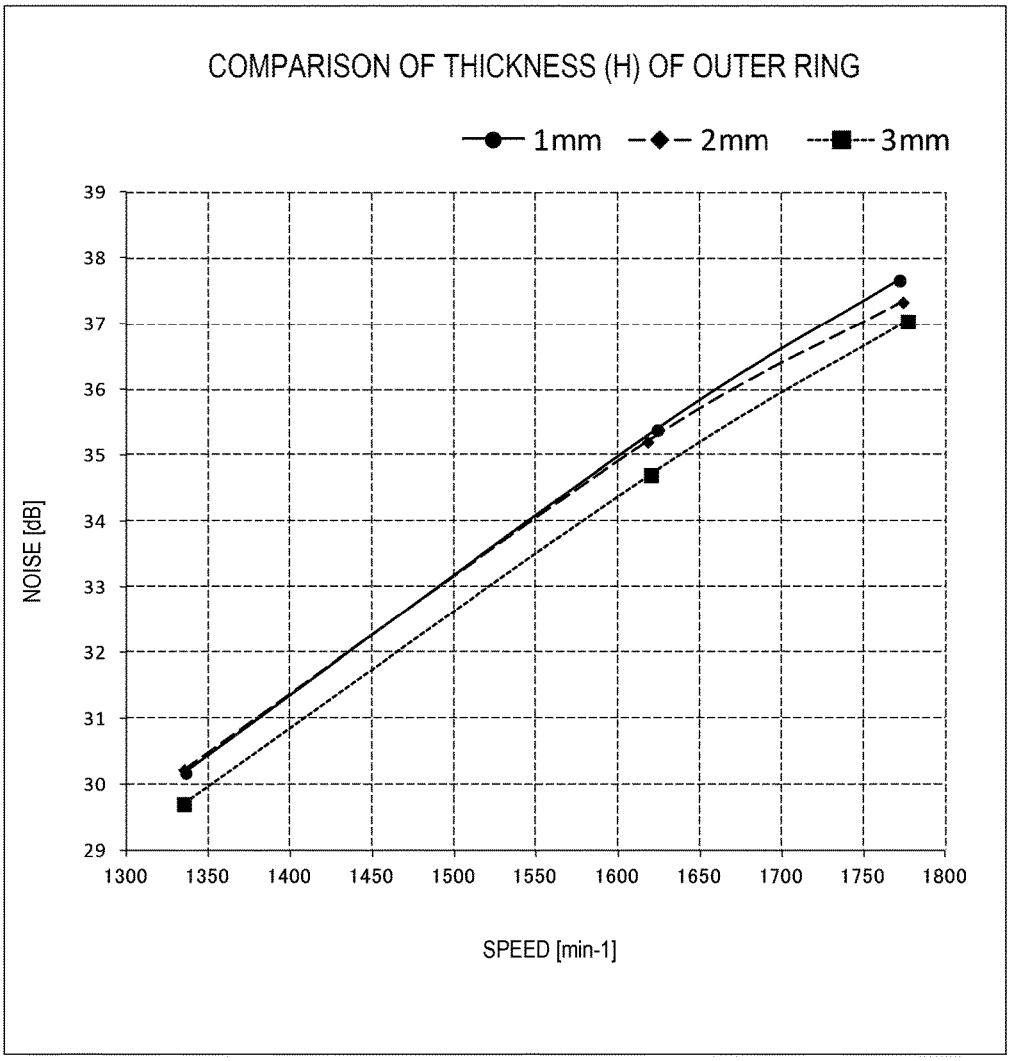
FIG. 17 is a noise characteristics diagram of a centrifugal fan using the impeller in accordance with heights of an outer ring.

FIG. 17 is a noise characteristics diagram of a centrifugal fan using the impeller 10 in accordance with heights of the outer ring 61.

As shown in FIG. 17, regarding the noise characteristics, as the height h of the outer ring 61 is increased (as the outer ring 61 is thicker), the noise level is reduced in the entire range of the revolutions. The reason is that as the height h of the outer ring 61 is increased, the stiffness of the impeller 10 is increased. Thus, it can be said that it is preferable to increase the height h of the outer ring 61 so as to suppress the noise when the height of the outer ring 61 is within the range of 1 mm to 3 mm.

[Effects of Illustrative Embodiment]

As described above, in the impeller for a centrifugal fan having the outer ring, the trailing edge portions of the blades are bent in the rotating direction at the connection parts of the blades and the outer ring. Therefore, the lifespan of the mold for molding the impeller can be extended. Also, the impeller having high stiffness can be configured without deteriorating the characteristics of the centrifugal fan as regards the air volume, the static pressure, the noise and the like.

Since the blade has the spiral shape and the thickness of the blade is uniform from the side of the suction opening to the side of the discharge opening, the impeller can be lightened. Since the height of the outer ring range from one to three times of the thickness of the blade, it is possible to secure the strength of the connection parts of the blades and the outer ring, thereby improving the overall stiffness of the impeller.

Since the outer ring is formed with the thickness-reduced relief parts, the impeller can be easily molded. Also, the balance of the impeller can be secured. Since the height of the outer ring is 50% or smaller of the height of the blade, the stiffness can be effectively increased without lowering the blowing characteristics. When the height of the outer ring is set to be 15% or smaller of the height of the blade, the effect can be more effectively achieved.

The impeller is integrally molded using the resin. Also, the outer dimension of the main plate is made to be smaller than the inner diameter of the outer ring. Therefore, the impeller having the high balance can be easily manufactured at low cost by adopting the mold of two-divided structure.

[Others]

The connection angle between the blade and the outer ring is not limited to the above angle. For example, the angle may be set to be 90°.

Figure 18:
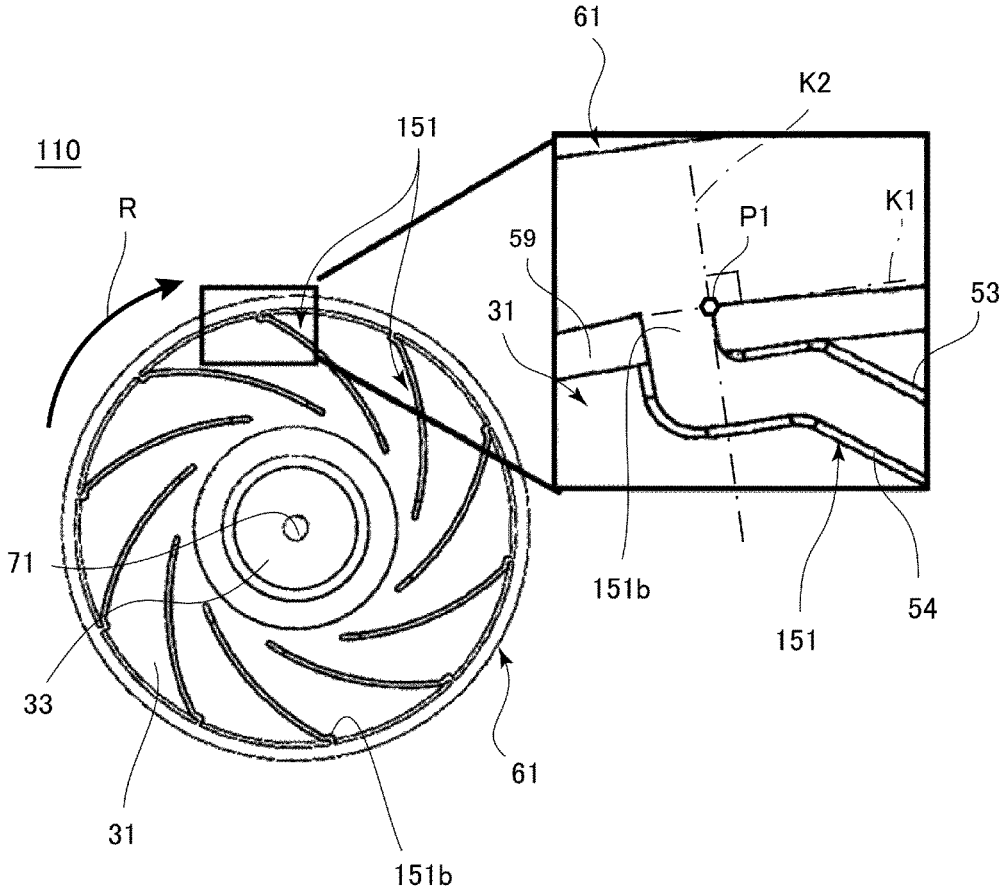
FIG. 18 shows an impeller of a centrifugal fan according to a modified embodiment of the illustrative embodiment.
Figure 19:
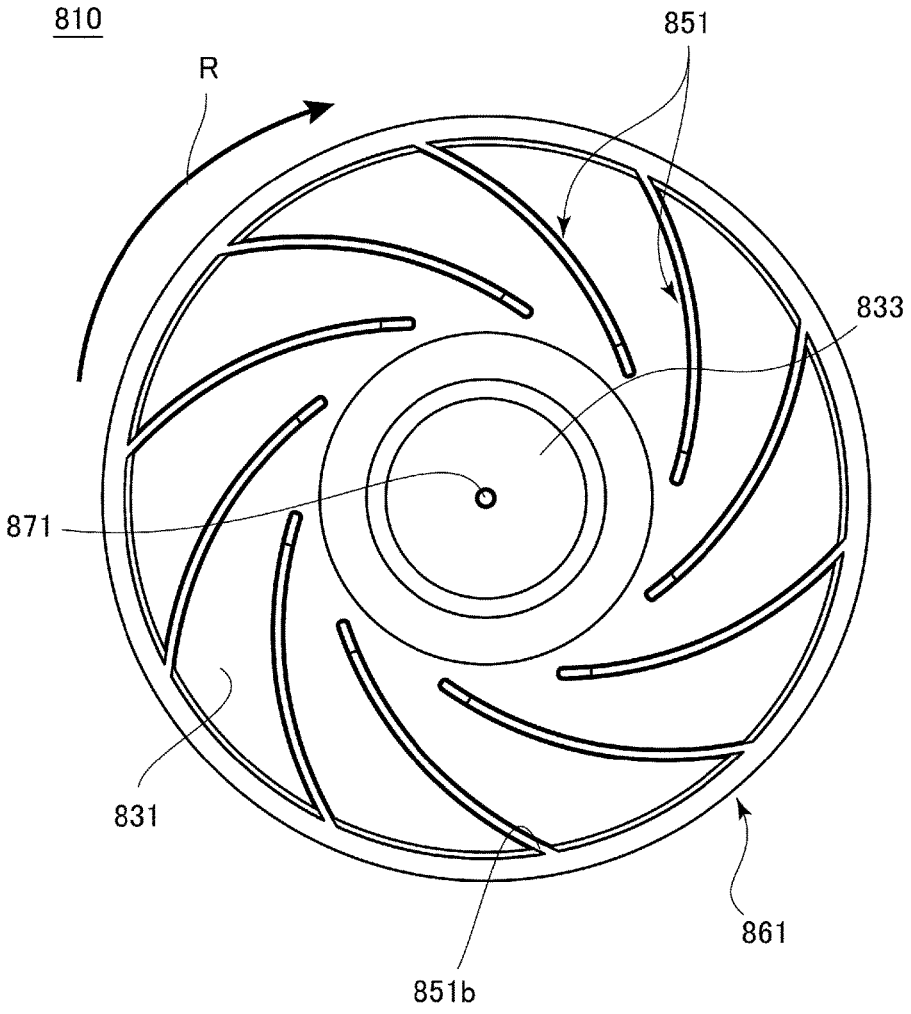
FIG. 19 is a plan view showing a related-art impeller for a centrifugal fan having an outer ring.
Figure 20:
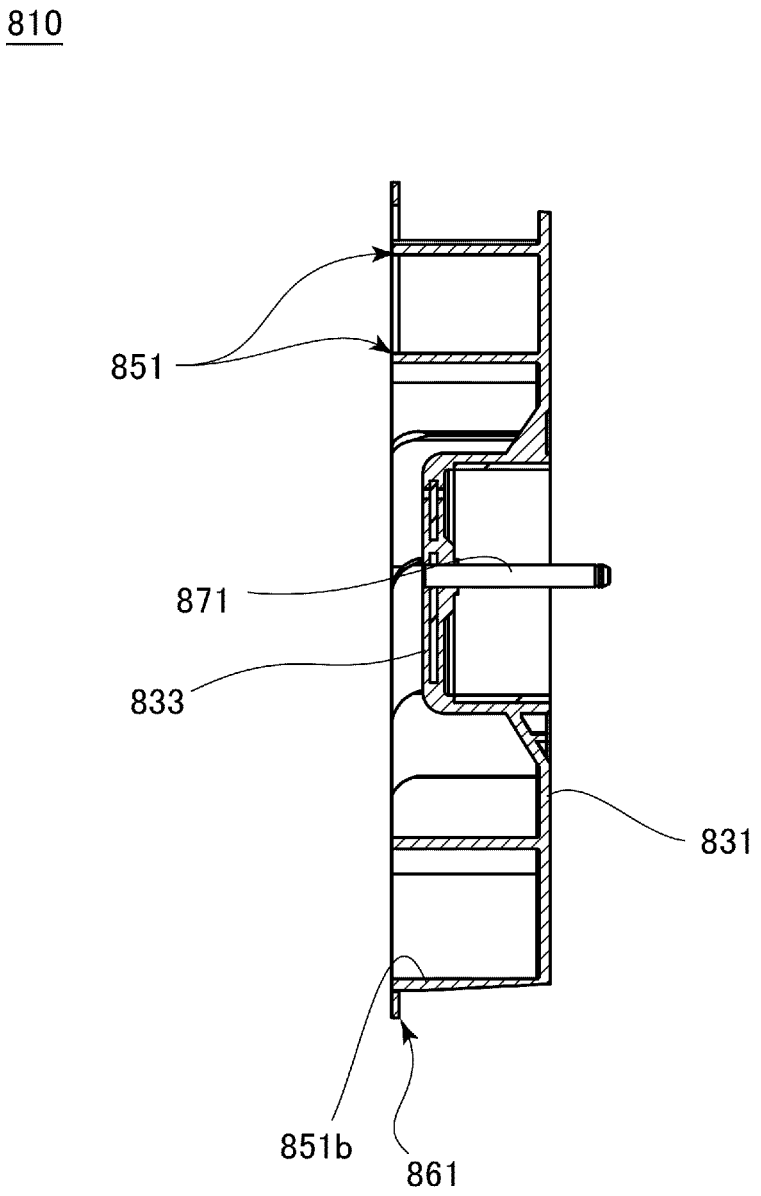
FIG. 20 is a side sectional view of the related-art impeller.

FIG. 18 shows an impeller of a centrifugal fan according to a modified embodiment of the illustrative embodiment.

As shown in FIG. 18, an impeller 110 has the same configuration as the impeller 10, except that a blade 151 of the impeller 110 has a different shape of a trailing edge portion. Meanwhile, in FIG. 18, the thickness-reduced relief parts of the outer ring 61 are not shown.

In this modified embodiment, a portion close to a trailing edge portion 151*b* of the blade 151 is bent in the rotating direction R and is substantially perpendicularly connected to the inner periphery of the outer ring 61. That is, when seen from a plan view, a tangent line to the connection point P1 on the inner periphery of the outer ring 61 is substantially orthogonal to the line K2 corresponding to the pressure surface 53 of the trailing edge portion 151*b*.

Even when the connection angle of the blade 151 and the outer ring 61 is about 90°, the same effects as the above illustrative embodiment can be achieved. That is, in a mold for molding the impeller 110, a tip end portion for molding the trailing edge portion 151*b* is preferably configured to have an angle of 90°. Therefore, the mold is not apt to be fractured, so that the lifespan of the mold can be extended.

Regarding the impeller, the shapes, positions and existence or non-existence of the rotor holder, the thickness-reduced relief parts and the like are not limited to the above illustrative embodiment. The number of the blades may be larger or smaller than the above illustrative embodiment. In each blade, the shape of the part except for the trailing edge portion is not limited to the above illustrative embodiment.

The impeller for a centrifugal fan is not limited to the open impeller type. The inventive concept of the present invention can be applied to all centrifugal fans such as a sirocco type, a radial type and the like.

While the present invention has been shown and described with reference to certain illustrative embodiments thereof, it will be understood by those skilled in the art that various changes in form and details may be made therein without departing from the spirit and scope of the invention as defined by the appended claims.

What is claimed is:

1. An impeller for a centrifugal fan, comprising:

a main plate having a disc shape;

a rotary shaft attached to the main plate;

a plurality of cylindrical pillars disposed around the rotary shaft, each of the cylindrical pillar of the plurality of cylindrical pillars being arranged to have a substantially equal interval between adjacent cylindrical pillars;

a plurality of blades arranged along a circumferential direction about a center part of the main plate; and an outer ring having a ring shape connecting the respective blades, wherein the outer ring is connected to tip end portions of the respective blades at a side of a fluid discharge opening, wherein each of the blades has a straight line portion and an arc portion as seen from a axial direction along which the rotary shaft extends, wherein a first end of the straight line portion is connected to the outer ring as seen from the axial direction, wherein a second end of the straight line portion is connected to the arc portion and away from the outer ring as seen from the axial direction, wherein an outer diameter size of the main plate is smaller than an inner diameter size of the outer ring, and wherein the main plate, the blades, and the outer ring are made of resin and are integrally molded.

2. The impeller according to claim 1, wherein each blade is a backward inclined blade and has a blade thickness which is substantially uniform from a side of a fluid suction opening to the side of the fluid discharge opening.

3. The impeller according to claim 1, wherein a size of the outer ring in an upper-lower direction ranges from one to three times of a thickness of each blade.

4. The impeller according to claim 1, wherein a connection angle, which is formed between a pressure surface of each blade and a surface of the outer ring at a connection part of the tip end portion of the blade and the outer ring, ranges from 30° to 90°.

5. The impeller according to claim 1, wherein the outer ring is formed with a plurality of thickness-reduced relief parts which are arranged along the circumferential direction about the center part of the main plate.

6. The impeller according to claim 1, wherein a size from an upper end of the tip end portion of each blade to a lower end of the outer ring in an upper-lower direction ranges 50% or smaller of a size from the upper end of the tip end portion of the blade to an upper surface of the main plate in the upper-lower direction.

7. The impeller according to claim 1, wherein each blade has a shape configured by connecting a plurality of circular arcs.

8. A centrifugal fan comprising:

the impeller according to claim 1; and a motor configured to rotate the rotary shaft.

9. The centrifugal fan according to claim 8, wherein the main plate includes:

a rotor holder which is integrally molded at a center of the main plate;

an inclined part arranged at an outer side of the rotor holder, wherein a recess part is defined by a bottom surface of the inclined part; and a rib formed in the recess part and connecting the rotor holder and the inclined part, wherein the rib is formed with a cylinder part.

10. The impeller according to claim 1, wherein a first connection angle between the straight line portion and the outer ring is 45 degrees or more and 80 degrees or less as seen from the axial direction.

11. The impeller according to claim 10, wherein a second connection angle between the straight line portion and the arc portion is 135 degrees or more as seen from the axial direction.

12. The impeller according to claim 1, wherein a second connection angle between the straight line portion and the arc portion is 135 degrees or more as seen from the axial direction.

13. The impeller according to claim 1, wherein the plurality of cylindrical pillars are disposed between the rotary shaft and the main plate as seen from the axial direction.

* * * * *